US008464762B2

(12) United States Patent
Toujas et al.

(10) Patent No.: US 8,464,762 B2
(45) Date of Patent: Jun. 18, 2013

(54) STRAW PACKAGING MACHINE

(75) Inventors: Claude Toujas, Saint-Ouen sur Iton (FR); Christian Beau, Voisins le Bretonneux (FR)

(73) Assignee: IMV Technologies, L'Aigle (FR)

( * ) Notice: Subject to any disclaimer, the term of this patent is extended or adjusted under 35 U.S.C. 154(b) by 594 days.

(21) Appl. No.: 12/677,002

(22) PCT Filed: Sep. 4, 2008

(86) PCT No.: PCT/FR2008/051574
§ 371 (c)(1),
(2), (4) Date: Mar. 8, 2010

(87) PCT Pub. No.: WO2009/044043
PCT Pub. Date: Apr. 9, 2009

(65) Prior Publication Data

US 2010/0200113 A1 Aug. 12, 2010

(30) Foreign Application Priority Data

Sep. 7, 2007 (FR) ..... 07 57438

(51) Int. Cl.
*B65B 1/04* (2006.01)

(52) U.S. Cl.
USPC ..... 141/18; 141/59; 141/266; 141/283; 53/236

(58) Field of Classification Search
USPC ..... 53/236; 141/18, 59, 65, 250, 266, 141/283, 285
See application file for complete search history.

(56) References Cited

U.S. PATENT DOCUMENTS

| | | | | |
|---|---|---|---|---|
| 2,094,524 | A * | 9/1937 | Busch | 141/59 |
| 3,931,661 | A | 1/1976 | Horsting et al. | |
| 5,249,610 | A | 10/1993 | Cassou et al. | |
| 6,732,486 | B2 | 5/2004 | Saint-Ramon et al. | |

FOREIGN PATENT DOCUMENTS

| | | | |
|---|---|---|---|
| CN | 533542 | A | 2/1973 |
| DE | 20100106 | U1 | 4/2001 |
| EP | 1125870 | A1 | 8/2001 |
| FR | 2680101 | A1 | 2/1993 |

* cited by examiner

*Primary Examiner* — Gregory Huson
*Assistant Examiner* — Jason K Niesz
(74) *Attorney, Agent, or Firm* — Browdy and Neimark, PLLC

(57) ABSTRACT

The invention relates to a machine for conditioning chaff (11) of predetermined diameter, that comprises a filling unit (3) for said chaff (11), including n filling stations (4), and a conveying device (2) for said chaff, said device (2) including at least one conveying member (5) provided with a succession of receiving housings (15) for said chaff (11) arranged along a predetermined pitch (E), said conveying member (5) further including, in addition to said succession of receiving housings (15) for said chaff (11) or first housings, a succession of receiving housings (16) or second housings for the chaff having another predetermined diameter, said second housings (16) being arranged along said pitch (E), and each of said second receiving housings (16) being provided between two first receiving housings (15).

9 Claims, 5 Drawing Sheets

STRAW PACKAGING MACHINE

The present invention concerns the packaging of predetermined doses of liquid substance in straw.

It is known that straws are packaging units formed of a thin plastic material tube the inside diameter of which is in particular sufficiently small for the dose of liquid substance to be retained in place by capillary action and a stopper engaged in the thin tube near one end.

There are also known, particularly from patent application EP 1 125 870, machines for packaging such straws in which these straws, previously disposed in a dispensing hopper, are routed by means of a conveyor device to a unit for filling the straws and then to a unit for welding the filled straws, the filling unit being provided with four filling stations disposed side by side with a predetermined distance between each station, each filling station having a filling nozzle and a suction nozzle to be nested in sealed manner at each end of a corresponding straw.

The conveyor device of such a machine is formed of a pair of identical conveyor belts designed for straws of a particular diameter (like the belts shown in FIGS. 1 and 2 for two different straw diameters). These belts are disposed at a distance from each other and each is provided with a succession of housings for receiving said straws, these housings being disposed according to a predetermined pitch (that is to say the distance separating the distances between centers of two successive housings) equal to the predetermined distance between the filling stations to be able to place each straw in a group of four in alignment with a corresponding filling station (that is to say between a corresponding suction nozzle and a corresponding filling nozzle).

Filling is effected by a movement toward each other of the filling and suction nozzles toward the straws which are then filled simultaneously. Once the latter straws have been filled, the belts are moved by a distance equal to four times the pitch referred to above in order to place four new empty straws beside the four straws that have just been filled between the corresponding filling and suction nozzles, the filled straws being then conveyed to the welding unit.

The invention aims to provide a machine of the same type but more convenient at the same time as remaining economical and retaining good performance.

To this end it proposes a machine for packaging straws of a predetermined diameter including a filling unit for said straws including n filling stations, n being an integer number equal to at least 1, and a conveyor device for said straws for disposing n straws each in line with one of said filling stations, said device having at least one conveyor element provided with a succession of receiving housings for said straws disposed according to a predetermined pitch, said conveyor element being adapted to be moved, after each filling of n straws, a distance equal to n times said predetermined pitch to dispose n new straws next to the preceding n straws, each in line with one of said filling stations, characterized in that said conveyor element includes, in addition to said succession of receiving housings for said straws, referred to as first housings, a succession of receiving housings for straws of another predetermined diameter, referred to as second housings, said second housings being disposed according to said pitch, each of said second receiving housings being disposed between two of said first receiving housings.

Thus the conveyor device of the machine of the invention is rendered compatible with straws of different diameters, for example straws of small diameter and large diameter, without having to replace the conveyor element. When the machine is used with straws of small diameter, the latter straws are disposed in the appropriate housings. The same applies when the machine is used with straws of large diameter except that in this case the straws are received in the other housings. To go from one use of the machine to the other it suffices to move the conveyor element by half of one pitch to change the type of straws to be aligned with the filling stations.

The interleaving of the housings for straws of different diameters also preserves for a given length of the conveyor element the same number of straws of the same diameter that can be conveyed by that element as for the conveyor elements of the prior art machine. In the machine of the invention the density of straws of the same diameter (i.e. the number of straws of the same diameter per unit length) is unchanged because the space separating two identical housings is exploited to interleave supplementary housings (for straws of different diameter). It is therefore in particular not necessary to lengthen the conveyor element.

According to features preferred for reasons of simplicity and convenience as much in manufacture as in use, if n is equal to at least 2, with said filling stations that are disposed side-by-side with a predetermined gap, said predetermined pitch of said conveyor element is equal to said predetermined gap.

Thus the machine of the invention is particularly polyvalent because it packages straws of different diameters at low additional cost. The pitch separating two identical housings being preserved regardless of the type of housing and chosen to be equal to the predetermined distance between two filling stations, with the first and second housings that are interleaved with each other, the conveyor device of the machine of the invention thus leads to no major change in the configuration of the prior art machine, the machine of the invention remaining compatible with existing straw filling and welding stations as well as with the mechanism for moving the conveyor element.

According to other features preferred for the same reasons as stated above, said conveyor element includes a belt in which are provided first gutters of predetermined diameter forming said first housings and second gutters of another predetermined diameter forming said second housings.

According to further preferred features, said conveyor element includes a first belt and a second belt disposed side-by-side, said first housings belonging to said first belt, said second housings belonging to said second belt.

According to further preferred features, said first belt is offset by half said pitch relative to said second belt and there are provided in said first belt, between said first housings, grooves situated in line with said second housings of said second belt and there are provided in said second belt, between said second housings, grooves situated in line with said first housings of said first belt.

The conveyor device of the machine of the invention can thus be produced from two conventional belts by machining those belts to form the corresponding grooves therein and moving these belts by half of one pitch relative to each other, each straw thus being accommodated in a corresponding housing and in a groove aligned with that housing.

According to further preferred features:

said grooves are crenellated grooves;

each of said conveyor elements has on the side opposite said housings a succession of teeth;

said device includes, in addition to said conveyor element, referred to as the first element, a second conveyor element identical to and parallel to said first conveyor element and spaced from said first conveyor element by a distance less than the length of said straws to be packaged; and/or each filling station includes, on respective opposite sides of the conveyor device, a suction nozzle and a filling nozzle for the liquid to be introduced into said straws.

The features and advantages of the invention will emerge from the following description, given by way of preferred, but not limiting, example, with reference to the appended drawings, in which.

Figure 4:
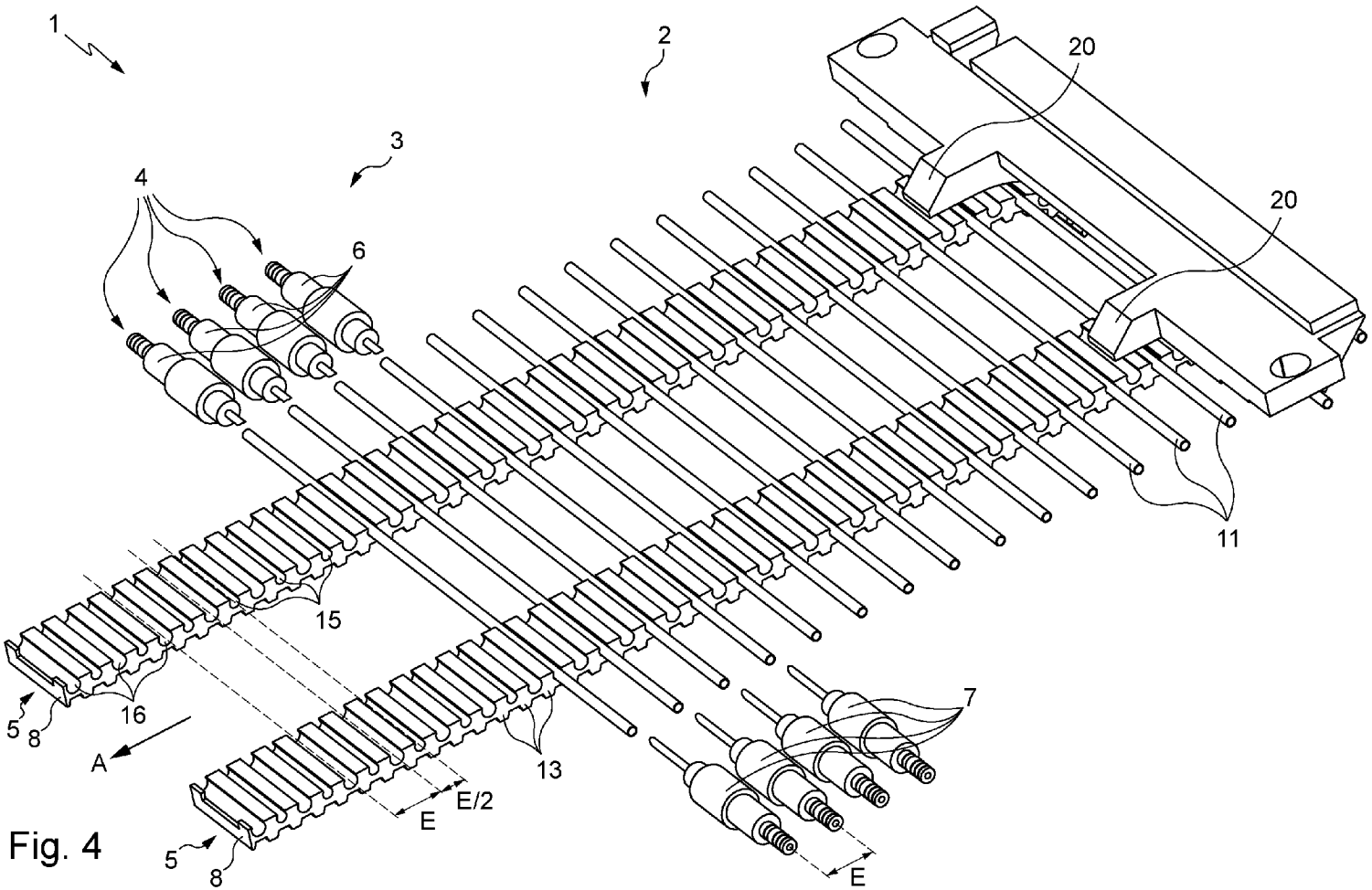
FIG. 4 is a perspective view of part of this machine in which are represented four filling stations disposed side-by-side and a conveyor device provided with two conveyor elements, here two belts as shown in FIG. 3, disposed parallel and in which straws of small diameter are engaged.
Figure 5:
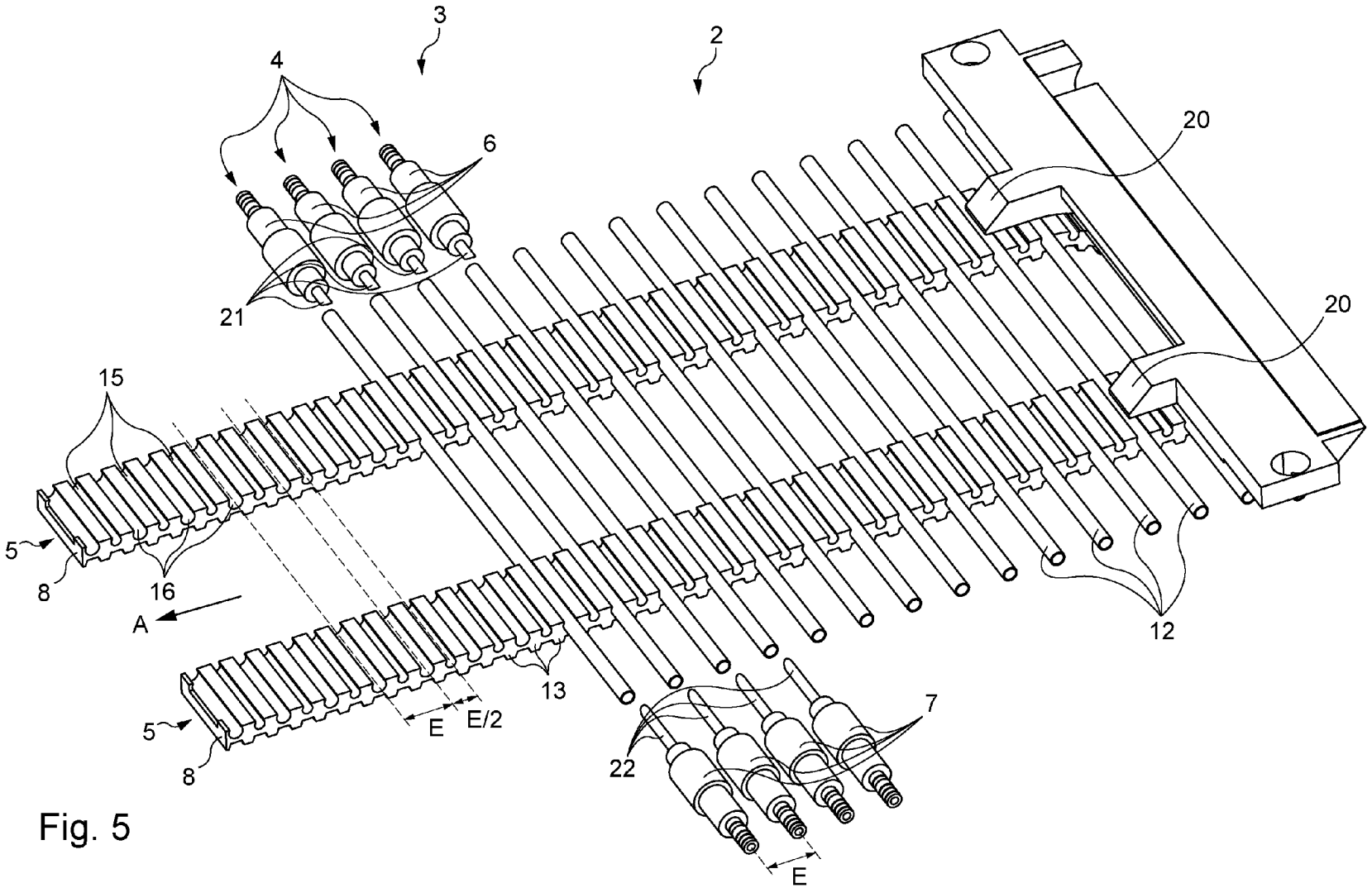
FIG. 5 is a view similar to FIG. 4 except that in this case it is straws of large diameter that are engaged in the two belts.

The machine as shown partly in FIGS. 4 and 5 comprises a certain number of equipment units necessary for packaging initially empty straws.

In the example shown the straws are straws of which the stopper (not shown) includes two porous plugs and between those plugs a volume of gel powder, that is to say powder that is transformed into a gel in contact with an aqueous liquid, but the machine of the invention can of course be used for other types of straws, particularly with stoppers of different design.

This machine 1 includes a fixed frame (not shown) supporting a removable and interchangeable hopper (not shown) containing a batch of empty small straws 11 of the order of 2 mm in diameter (FIG. 4), or empty large straws 12, of the order of 3 mm in diameter (FIG. 5), a conveyor device 2 for these straws, a filling unit 3 including four filling stations 4 for filling the straws with semen, a welding unit including four welding stations (not shown), for example ultrasound welding stations, for welding the ends of the straws once filled, and, finally, a receptacle for receiving filled and welded straws (also not shown).

The distribution hopper that is not shown is a parallelepiped-shaped box with an open top for loading into it a batch of empty straws and delivering the straws one-by-one to the conveyor device 2.

The unit 3 includes four filling stations 4 disposed side-by-side at a predetermined distance, each filling station 4 being provided with a suction nozzle 6 and a filling nozzle 7.

The filling and suction nozzles are respectively connected to a flask of semen, not shown, and to a vacuum source, also not shown, by means of flexible pipes.

The conveyor device 2 includes two conveyor elements 5 spaced from each other by a distance less than the length of a straw and a mechanism for driving rotation of these elements including a hub driven by a motor (not shown).

Each conveyor element 5 is formed of a belt 8 having a first succession of receiving housings 15 for straws such as 11 (straws of small diameter) and a succession of receiving housings 16 for straws such as 12 (straws of large diameter). The housings 15 are disposed according to a predetermined pitch E (distance between the distances between centers of two successive identical housings) equal to the predetermined distance between the filling stations 4, and the same applies to the housings 16, each housing 16 being disposed half-way between two housings 15.

The belts 8 cooperate with the hub of the drive mechanism via a series of teeth 13 situated on the side opposite the housings 15 and 16.

Figure 3:
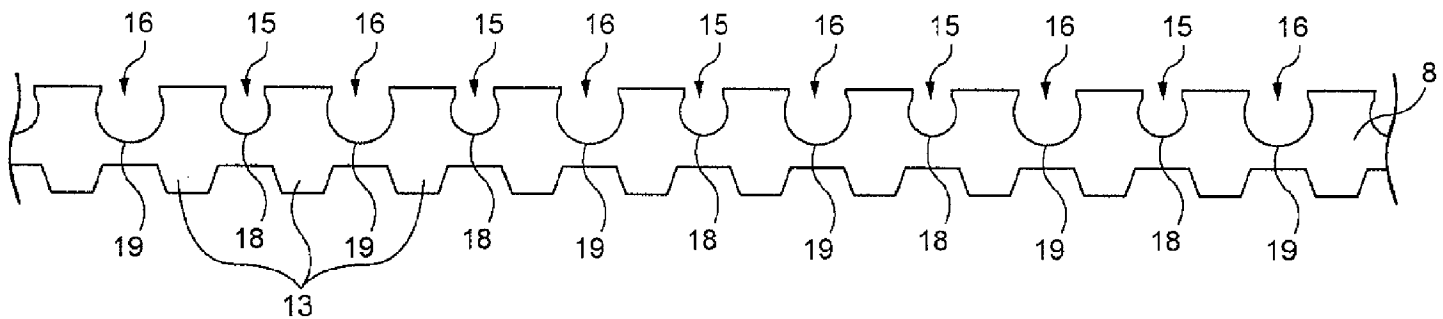
FIG. 3 is a view similar to FIGS. 1 and 2 but showing a conveyor belt portion of a machine of the invention.

As shown in FIG. 3, each housing 15 (respectively 16) has the shape of a gutter 18 (respectively 19) in the hollow of which a straw of the corresponding diameter is received.

The conveyor device 2 is also provided, for each belt, with an element 20 for guiding these belts.

The method of packaging straws used by this machine is described next.

Initially, by movement of the belts 8 in the direction of the arrow A, the straws initially stored in the hopper (the straws 11 or the straws 12) are distributed by that hopper into the corresponding housings of the belts where those belts are curved, in the vicinity of the guide elements 20, the curvature of the belts opening the housings 15 and 16 to facilitate the loading of the straws. The dimensions of the housings (respectively 16) are chosen so that the straws 11 (respectively 12) that are housed therein are held immobile in those housings after loading in order for the subsequent filling step to be carried out under good conditions, particularly on insertion of the suction and filling nozzles into the straws.

The motor is controlled so that the belts move so as to convey the straws, in groups of four, to the filling unit 3 where each straw of this group is aligned with a corresponding filling station 4.

In this position, the movement of the belts 8 is stopped and the suction nozzles 6 and filling nozzles 7 of those stations effect a movement toward each other in the direction of the end portions of the straws that project from the belts to engage the suction canula 21 and the filling canula 22 in these end portions in sealed manner (FIG. 5).

Suction is then applied so that, for each straw of the group of four straws, the semen passes through the filling nozzle to be introduced into the interior of the corresponding straw until it comes into contact with the stopper of that straw (not shown) which is thus sealed.

Once filling has been effected, the nozzles 6 and 7 are moved with a movement that is the converse of the movement effected to nest them in the straws so as to disengage the end portions of these straws. The motor of the conveyor device is then driven to move the belts in the direction of the arrow A by a distance equal to four times the pitch E in order to dispose new empty straws in the filling unit 3 and to dispose the four straws of the group of straws that have just been filled in the welding unit (not shown), this station including four welding stations with the same predetermined pitch E as the filling stations, each straw that has just been filled being aligned with a corresponding welding station to be welded there.

The motor of the conveyor device is then driven again to move the belts in the direction of the arrow A by a distance equal to four times the pitch E in order to move the welded straws to an accessory of the machine (not shown) for disengaging the straws from their housings so that they drop into a storage receptacle.

This cycle is thus reproduced regularly until the storage hopper is emptied of the straws that it contains.

To change the use of the machine, namely from packaging small straws 11 to large straws 12 or vice-versa, it suffices to drive the motor of this machine so that the hub causes the pair of belts 8 to advance over a distance equal to half the pitch E (i.e. E/2) so as to dispose in the filling stations 4 either a group of four housings 15 or a group of four housings 16.

Figure 7:
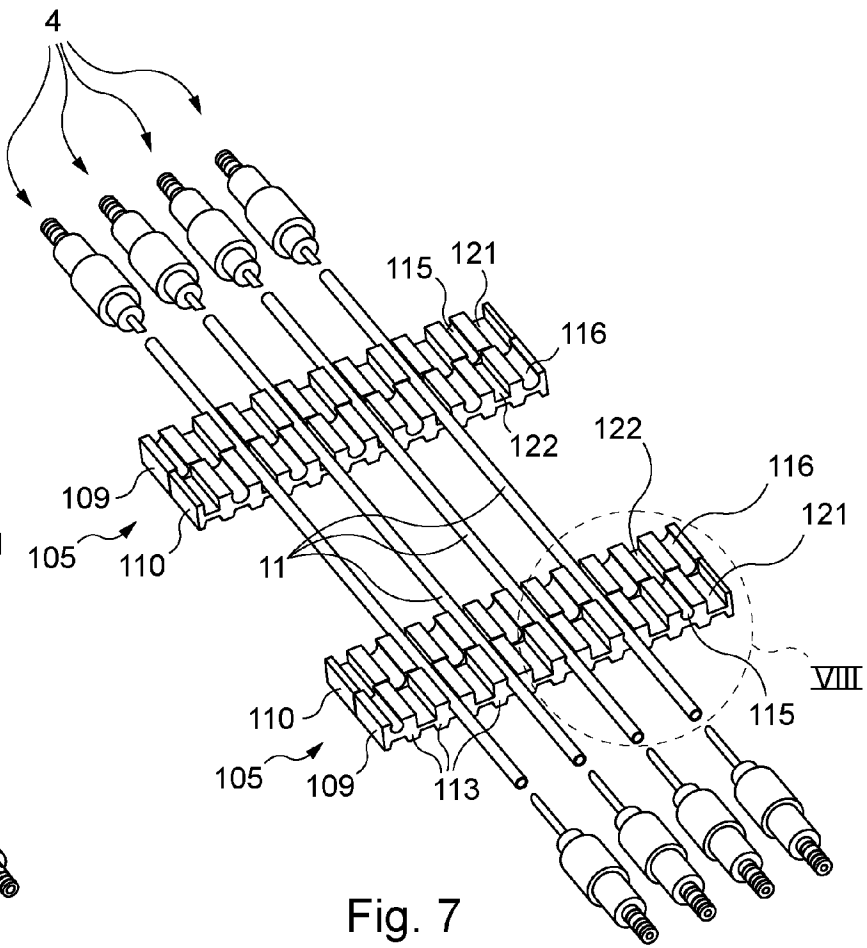
FIGS. 6 and 7 are two views showing, for straws of large diameter and straws of small diameter, respectively, a second embodiment of the machine of the invention in which the conveyor elements are arranged differently.
Figure 6:
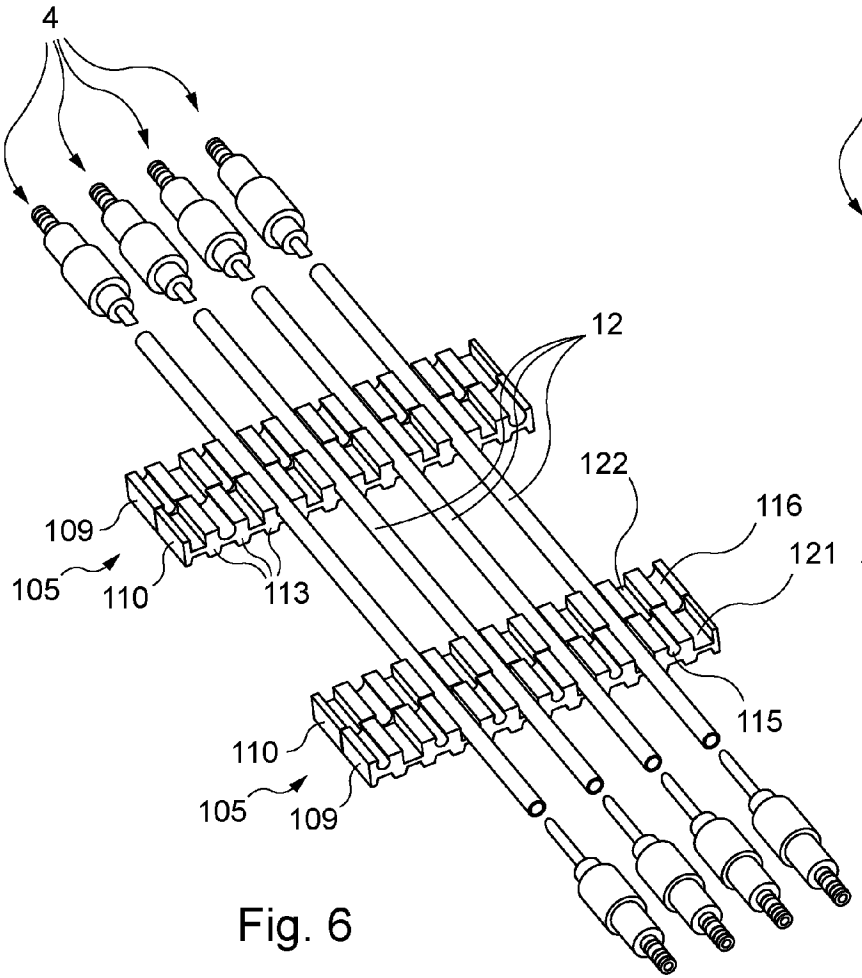
Figure 8:
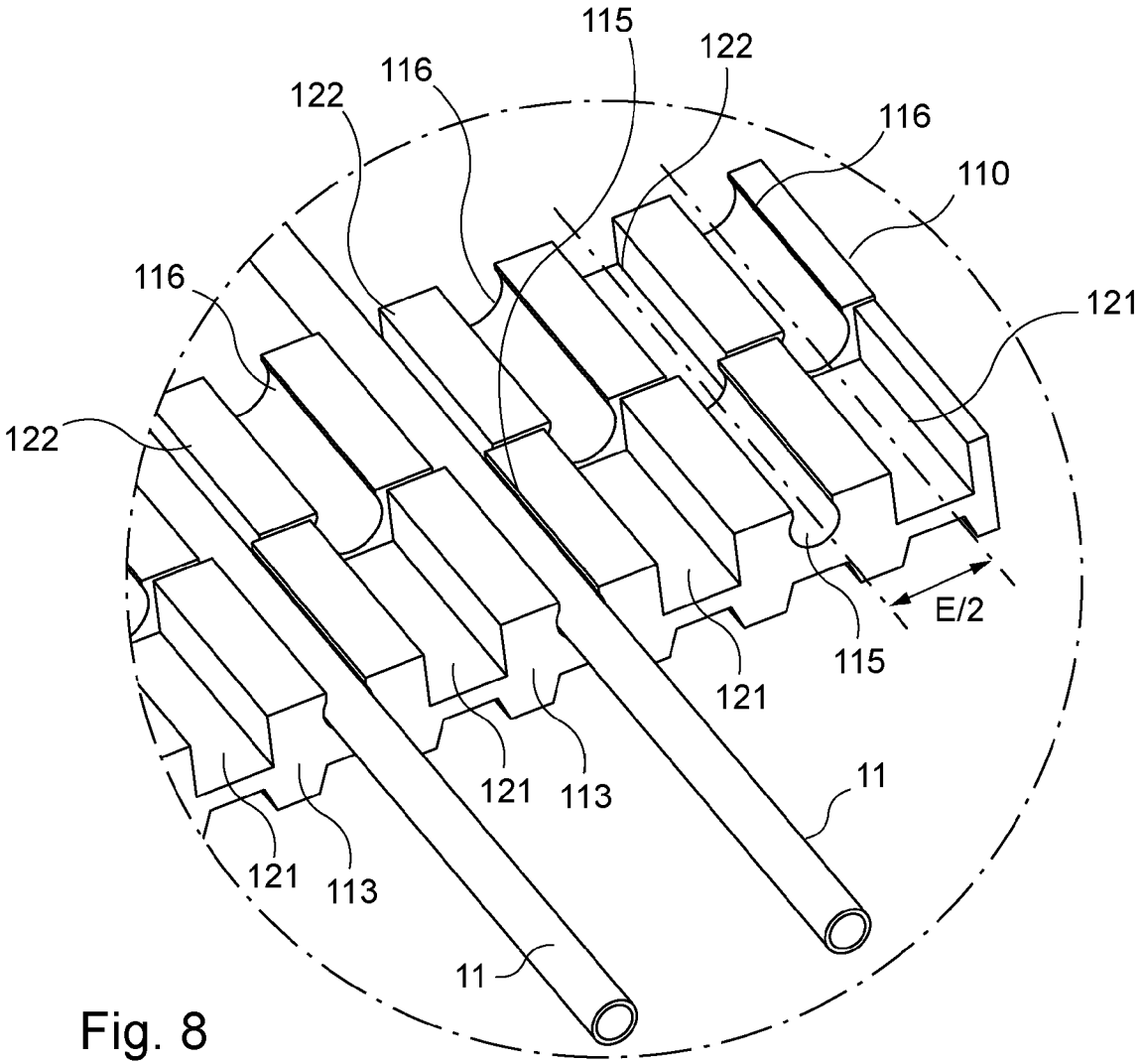
FIG. 8 is a view to a larger scale of the detail marked VIII in FIG. 7.

Another embodiment of the machine of the invention is shown in FIGS. 6 to 8.

Generally speaking, there have been used for similar elements the same reference numbers increased by 100 for this embodiment.

In this embodiment, each conveyor element 105 consists not of a belt 8 but of a pair of belts 109 and 110 disposed side-by-side and each derived from a prior art belt (similar to those shown in FIGS. 1 and 2) by machining. The belts 109 of each element 105 are disposed opposite each other relative to the belts 110 of these elements.

Figure 1:
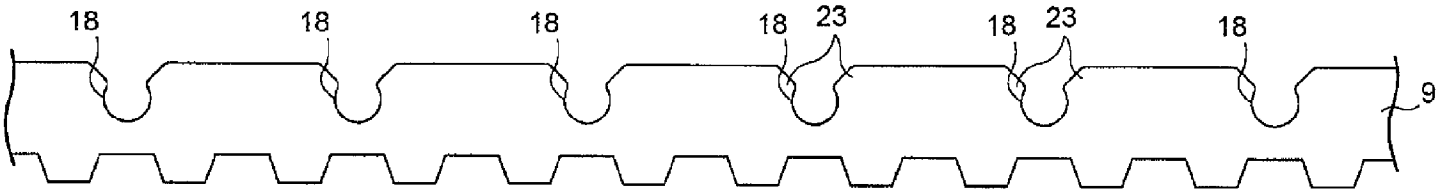
Fig. 1 (Prior Art)
FIGS. 1 and 2 are two views in elevation showing two prior art conveyor belt portions respectively designed to receive straws of small diameter and straws of large diameter.

As shown in FIG. 8, each belt 109 is obtained from a prior art belt similar to the belt 9 shown in FIG. 1 (except that the flared portions 23 of the belt 9 are not present in the belt 109) in which have been produced by machining crenellated grooves 121 between the housings 115 receiving the straws so that this modified belt 109 has a succession of receiving housings 115 of gutter shape for straws 11 of small diameter and between those housings a succession of crenellated grooves 121 for receiving therein straws 12 of large diameter.

Figure 2:
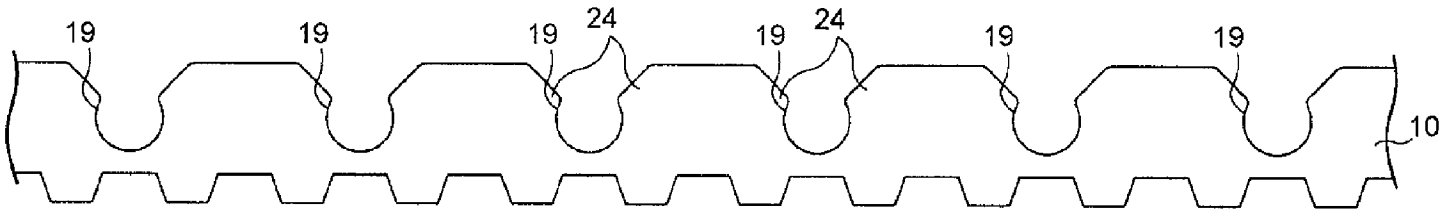
Fig. 2 (Prior Art)

Similarly, each belt 110 is obtained from a prior art belt similar to the belt 10 shown in FIG. 2 (except that the flared portions 24 of the belt 10 are not present in the belt 110) in which there have been produced by machining crenellated grooves 122 between the housings 116 for receiving straws so that this modified belt 110 has a succession of housings 116 of gutter shape for straws 12 of large diameter and between these housings a succession of crenellated grooves 122 for receiving therein straws 11 of small diameter.

For each conveyor element 105, the housings 115 of the belt 109 are offset by one half-pitch, i.e. E/2 (FIG. 8), relative to the housings 116 of the belt 110 alongside this belt so that the housings 115 are aligned with the groove 122 and the housings 116 are aligned with the grooves 121.

Consequently, and as shown in FIG. 6, each straw 12 of large diameter is accommodated in a crenellation 121 of one belt 109 and in a housing 116 of a belt 110 of the first conveyor element 105 as well as in a housing 116 of a belt 110 and in a crenellation 121 of a belt 109 of the second conveyor element 105.

Similarly, as shown in FIG. 7, each straw 11 of small diameter is accommodated in a housing 115 of a belt 109 and in a crenellation 122 of a belt 110 of the first conveyor element 105 and then in a crenellation 122 of a belt 110 and in a housing 115 of a belt 109 of the second conveyor element 105.

The motor and the hub of this embodiment of the machine do not in this case drive the two belts 8 but the two pairs of belts 109 and 110 via the teeth 113 of those belts, this embodiment of the machine advantageously enabling reuse of the conventional belts.

In a variant that is not shown, the belts 8, 109 and 110 have for each housing flared portions similar to the portions 23 and 24 of the belts 9 and 10 (FIGS. 1 and 2) adapted to center and to guide the straws toward the interior of the housings.

In a further variant, the belts of the machine are replaced by any other conveyor element having a similar arrangement, such as a single belt, a drum, a grooved mat or one or more notched disks.

In a further variant, the number n of filling stations is other than four, n being equal to at least one.

In a further variant, with a sufficient pitch E, the conveyor elements of the invention are adapted to receive straws not of two different diameters but of three or more than three different diameters, the successions of housings for each type of straw alternating, two successive identical housings still being separated by a pitch E, two successive housings of different types being then in this case separated by a distance equal to E/p where p corresponds to the number of types of straws of different diameter that can be received in these conveyor elements.

The present invention is not limited to the embodiments described and shown and encompasses any variant execution.

The invention claimed is:

1. Machine for packaging straws (11) of a predetermined diameter including a filling unit (3) for said straws (11) including n filling stations (4), n being an integer number equal to at least 1, and a conveyor device (2) for said straws for disposing n straws (11) each in line with one of said filling stations (4), said device (2) having at least one conveyor element (5; 105) provided with a succession of receiving housings (15; 115) for said straws (11) disposed according to a predetermined pitch (E), said conveyor element being adapted to be moved, after each filling of n straws, a distance equal to n times said predetermined pitch (E) to dispose n new straws next to the preceding n straws, each in line with one of said filling stations (4), wherein said conveyor element (5; 105) includes, in addition to said succession of receiving housings (15; 115) for said straws (11), referred to as first housings, a succession of receiving housings (16; 116) for straws (12) of another predetermined diameter, referred to as second housings, said second housings (16; 116) being disposed according to said pitch (E), each of said second receiving housings (16, 116) being disposed between two of said first receiving housings (15; 115).

2. Machine according to claim 1, wherein if n is equal to at least 2, with said filling stations (4) that are disposed side-by-side with a predetermined gap, said predetermined pitch (E) of said conveyor element (5; 105) is equal to said predetermined gap.

3. Machine according to claim 1, wherein said conveyor element (5) includes a belt (8) in which are provided first gutters (18) of predetermined diameter forming said first housings (15) and second gutters (19) of another predetermined diameter forming said second housings (16).

4. Machine according to claim 1, wherein said conveyor element (105) includes a first belt (109) and a second belt (110) disposed side-by-side, said first housings (115) belonging to said first belt (109), said second housings (116) belonging to said second belt (110).

5. Machine according to claim 4, wherein said first belt (109) is offset by half said pitch (E) relative to said second belt (110) and in that there are provided in said first belt (109), between said first housings (115), grooves (121) situated in line with said second housings (116) of said second belt (110) and in that there are provided in said second belt (110), between said second housings (116), grooves (122) situated in line with said first housings (115) of said first belt (109).

6. Machine according to claim 5, wherein said grooves (121, 122) are crenellated grooves.

7. Machine according to claim 1, wherein said conveyor element (5; 105) has on the side opposite said housings (15, 16; 115, 116) a succession of teeth (13; 113).

8. Machine according to claim 1, wherein said device includes, in addition to said conveyor element (5; 105), referred to as the first element, a second conveyor element (5; 105) identical to and parallel to said first conveyor element (5; 105) and spaced from said first conveyor element by a distance less than the length of said straws (11, 12) to be packaged.

9. Machine according to claim 1, wherein each filling station (4) includes, on respective opposite sides of the conveyor device (2), a suction nozzle (6) and a filling nozzle (7) for the liquid to be introduced into said straws (11, 12).

* * * * *